US005358447A

United States Patent [19]

Erickson

[11] Patent Number: 5,358,447

[45] Date of Patent: Oct. 25, 1994

[54] BOWLING RAMP

[76] Inventor: Bernard A. Erickson, 1411 Eastgate Pkwy., Rockford, Ill. 61108

[21] Appl. No.: 156,883

[22] Filed: Nov. 23, 1993

[51] Int. Cl.[5] ..... A63D 5/00

[52] U.S. Cl. ..... 473/56

[58] Field of Search ..... 473/56

[56] References Cited

U.S. PATENT DOCUMENTS

| | | | |
|---|---|---|---|
| 3,083,967 | 4/1963 | Steel | 473/56 |
| 3,159,401 | 12/1964 | Ikenberry | 473/56 |
| 3,481,601 | 12/1969 | Santora | 473/56 |
| 3,539,183 | 11/1970 | Lieb | 473/56 |
| 3,578,322 | 5/1971 | Kerr | 473/56 |
| 4,097,045 | 4/1977 | Bechtel | 473/56 |
| 4,441,710 | 5/1982 | Lay | 473/56 |

*Primary Examiner*—William H. Grieb

*Attorney, Agent, or Firm*—Mason, Kolehmainen, Rathburn & Wyss

[57] ABSTRACT

A new and improved bowling ramp useful for acceleration and directional control of a bowling ball by handicapped, disabled, weak and infirm persons of all ages includes a sloping guide track having a lower end adapted to rest on a bowling alley surface and an upper end having a horizontal segment adapted to support a bowling ball at rest. Portable legs are pivotally interconnected at their upper ends to support the upper end of the guide track and a lower end of each leg is adapted to engage the bowling surface in non-slipping engagement to provide lateral stability. The sloping guide track includes a frictional web surface on the downwardly sloping rails of the guide track for causing the bowling ball to spin and provide gyroscopic stability for the bowling ball as it is discharged down the ramp.

18 Claims, 3 Drawing Sheets

FIG. 1
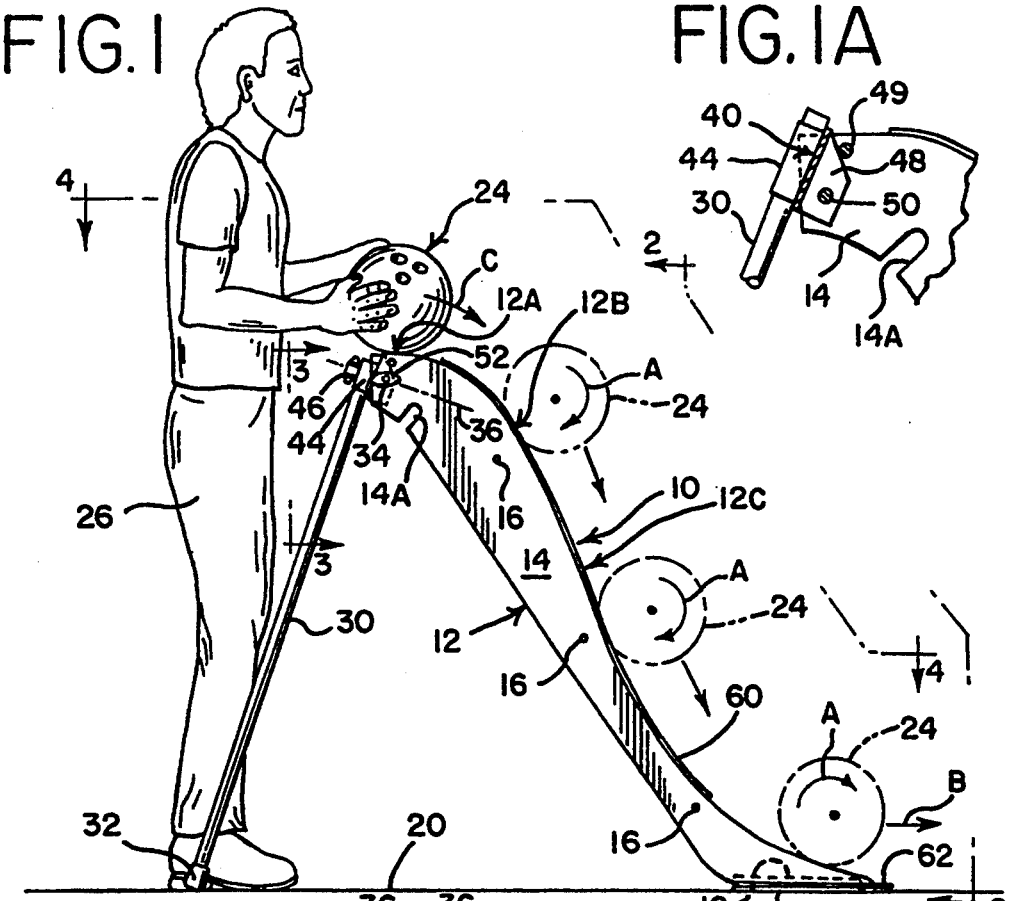
FIG. 1A
FIG. 2
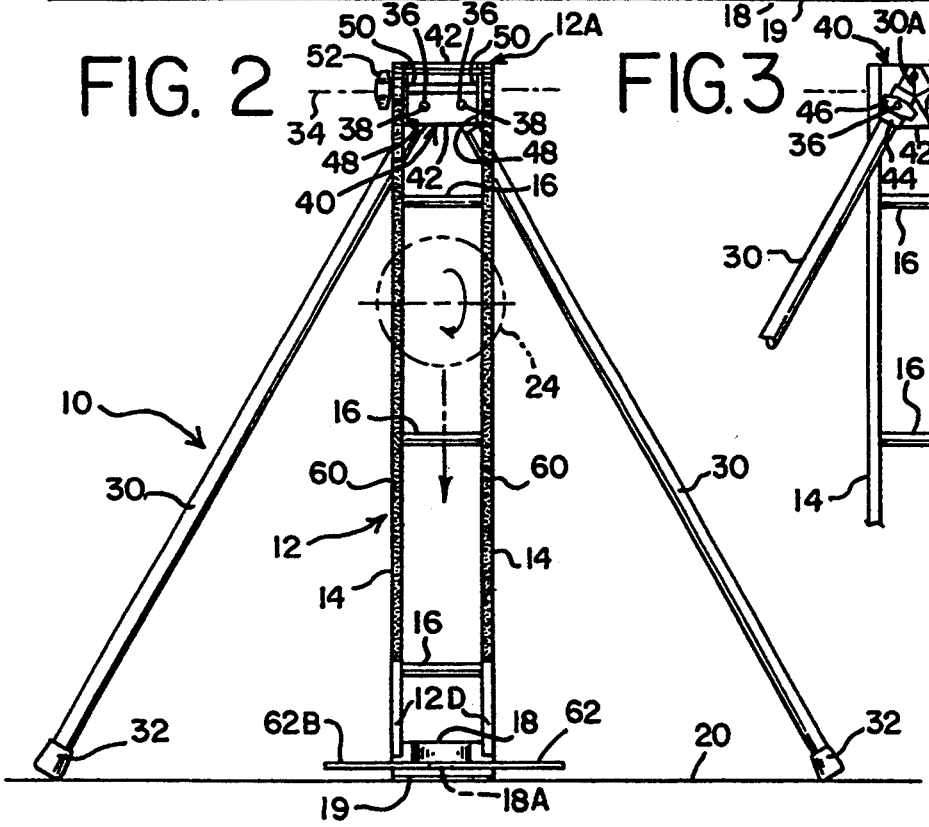
FIG. 3
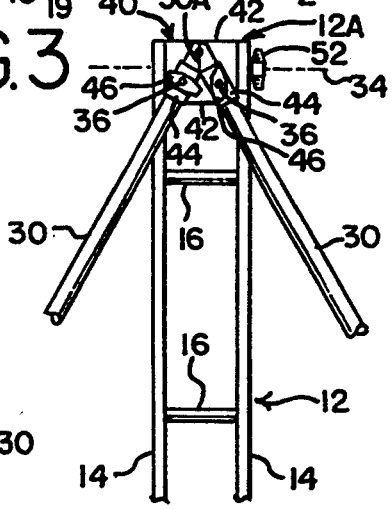

BOWLING RAMP

BACKGROUND OF THE INVENTION

1. Field of the Invention

The present invention relates to a new and improved bowling ramp especially designed for acceleration and precise directional control of a conventional bowling ball by handicapped, disabled, weak and infirm persons of all ages. The bowling ramp is designed to be light in weight, small in size and portable to be carried easily from place to place even by people of limited strength and coordination. The bowling ramp in accordance with the present invention permits a wide range of persons otherwise unable to enjoy the sport of bowling to enjoy the game in a full and interesting manner.

2. Background of the Prior Art

A number of patents have been developed for apparatus useful in permitting young or infirm persons to enjoy the sport of bowling. U.S. Pat. No. 3,083,967 discloses sports apparatus useful to permit people to engage in the sport of bowling while confined to wheelchairs. U.S. Pat. No. 3,159,401 discloses a gravity bowling ball projector for use by wheelchair patients. U.S. Pat. No. 3,481,601 discloses a bowling device wherein a bowler can line up a track to discharge a bowling ball in a selected direction down a bowling alley. U.S. Pat. No. 3,539,183 discloses a gravity bowling ball projector especially designed for use by elderly or otherwise handicapped persons for controlling the path of the bowling ball as it is discharged down the bowling alley. U.S. Pat. No. 3,578,322 discloses a ramp structure for use by a bowler sitting in a chair and discharging the bowling balls down the structure towards the bowling alley. U.S. Pat. No. 4,441,710 discloses a bowling ramp attachment for wheelchairs which is also useful for persons in a standing position. U.S. Pat. No. 4,097,045 discloses a bowling ramp for use by wheelchair patients and also useful for other purposes.

OBJECTS OF THE INVENTION

It is an object of the invention to provide a new and improved bowling ramp for acceleration and precision directional control of a bowling ball which is especially adapted for use by handicapped, disabled, weak and infirm persons of all ages so that these persons may engage in the fun and sport of bowling.

Another object of the present invention is to provide a new and improved bowling ramp of the character described which is easily set up in position to provide for speed and accuracy in the discharge of a bowling ball by a handicapped, weak or infirm person.

Another object is to provide a new and improved bowling ramp of the character described which may be folded-up into a compact, lightweight and small package easily carried and stored in an automobile trunk, duffel bag or the like.

Yet another object of the present invention is to provide a new and improved bowling ramp of the character described which requires no tools to assemble or disassemble or to unfold into a laterally and longitudinally stable operational position ready for use on a bowling surface.

Yet another object of the present invention is to provide a new and improved bowling ramp which includes an aiming device for lining up the ramp on a bowling alley surface to provide better accuracy in scoring.

Another object of the present invention is to provide a new and improved bowling ramp of the character described for by handicapped, weak or infirm persons of all ages which can be utilized for bowling type games in smaller enclosures on a carpeted floor, etc.

Still another object of the present invention is to provide a new and improved lightweight, strong and easy to handle bowling ramp which is easy to set up and take down and which provides longitudinal as well as lateral stability when set up ready for use and which does not slip or slide in any direction because of instability or lack of frictional contact as a bowling ball is discharged down the ramp.

Still another object of the present invention is to provide a new and improved bowling ramp of the character described which employs a novel frictional surface on a guide track to provide for spin rotation of a bowling ball as the ball moves down the track so that the spinning ball is gyroscopically stable and provides for more accurate directional control than would be the case if the ball merely slid down the ramp without substantial spin or rotation about its own spin axis.

Another object of the present invention is to provide a new and improved bowling ramp of the character described which has a relatively steep slope (for example, 65°) in order to generate enough speed and spin action on a bowling ball discharged down the ramp so that accuracy of bowling is greatly improved.

Still another object of the present invention is to provide a new and improved bowling ramp of the character described which is easily aimed or lined up with the surface of a bowling alley to provide greater accuracy and higher scoring.

BRIEF SUMMARY OF THE PRESENT INVENTION

The foregoing and other objects and advantages of the present invention are accomplished in a new and improved bowling ramp useful for acceleration and directional control of a conventional bowling ball by handicapped, disabled, weak and infirm persons of all ages. The bowling ramp includes a sloping guide track having a lower end adapted to rest on a bowling alley surface and an upper end having a horizontal segment adapted to support a bowling ball at rest. A pair of legs are pivotally attached at their upper ends to an upper end portion of the guide track and the lower ends of the legs are adapted to pivot laterally outwardly and also rearwardly of an upper end of the guide track. Lower ends of the legs are provided with friction elements adapted to provide non-slipping contact with the bowling surface and thereby provide lateral stability as well as longitudinal stability for the guide track in an operational position. The guide track includes a pair of spaced apart rails each having a downwardly sloping upper surface which is covered with a frictional tape medium adapted to frictionally engage the bowling ball rolling down the guide track so that the ball spins around its own axis rather than slides in order to provide the ball with gyroscopic stability as it is rolling down the bowling alley toward the bowling pins.

BRIEF DESCRIPTION OF THE DRAWINGS

For a better understanding of the present invention, reference should be had to the following detailed description, taken in conjunction with the drawings, in which:

FIG. 1 is a side elevational view of a new and improved bowling ramp constructed in accordance with the features of the present invention and shown in an erected or operational position ready for use by a bowler in a standing position;

FIG. 1A is a fragmentary cross-sectional view taken substantially along lines 1A—1A of FIG. 4;

FIG. 2 is a front end elevational view of the bowling ramp looking in the direction of arrows 2—2 of FIG. 1;

FIG. 3 is a fragmentary rear end elevational view of the bowling ramp looking in the direction of the arrows 3—3 of FIG. 1;

DETAILED DESCRIPTION OF A PREFERRED EMBODIMENT OF THE INVENTION

Figure 4:
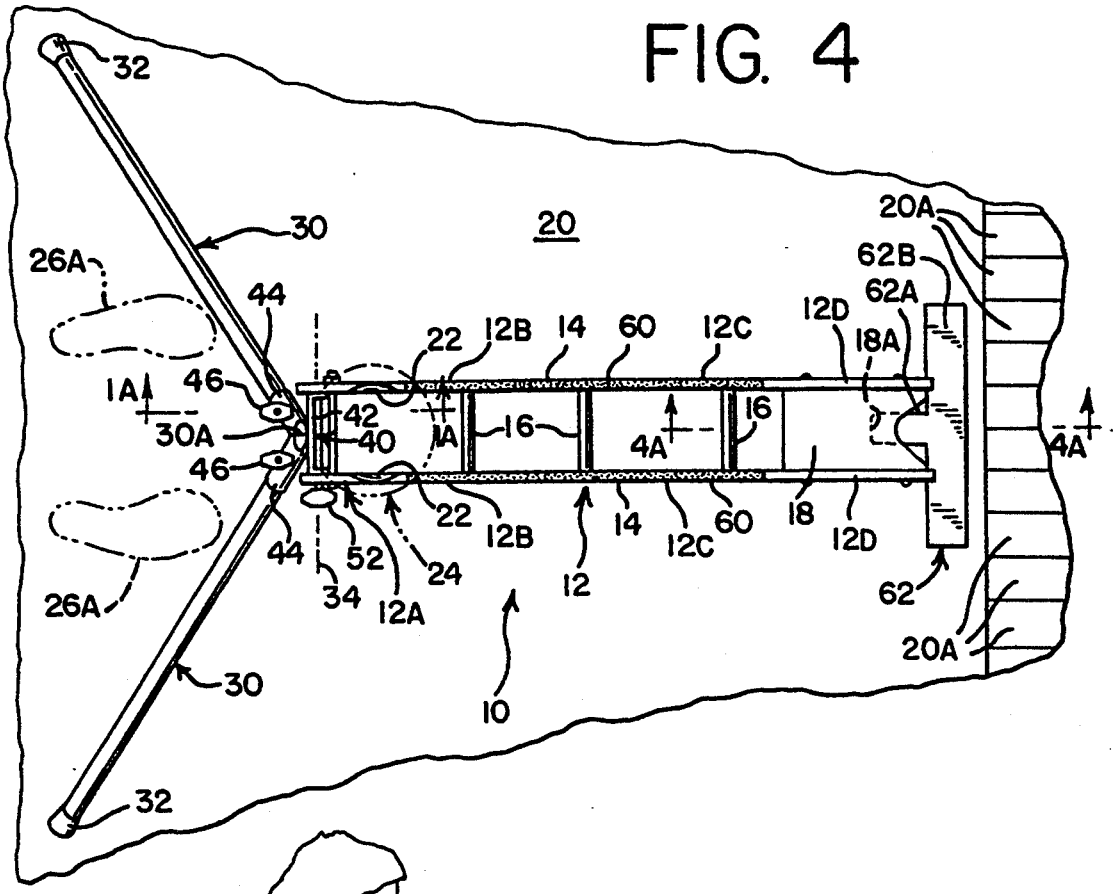
FIG. 4 is a top plan view of the bowling ramp looking downwardly in the direction of arrows 4—4 of FIG. 1.

Referring now more particularly to the drawings, therein is illustrated a new and improved bowling ramp 10 which is especially adapted and useful for accelerating and precision directional control of a bowling ball by handicapped, disabled, weak and infirm persons of all ages so they can enjoy the highly popular sport of bowling. The bowling ramp 10 includes an elongated guide track 12 having a pair of opposite guide rails 14 maintained in parallel spaced-apart relationship by a plurality of transverse dowels or cross-pins 16. At the lower end the side rails 14 are secured to a foot board 18 as shown in FIG. 4A, having a flat rubber friction pad 19 on the underside adapted to rest on the surface 20 of a bowling alley or other playing surface. The guide rails 14 may be constructed of plywood or other suitable sheet material such as plastic or metal and the spacers 16 may be formed of wood dowels and the like, or other tubular elements and/or metal tie bolts running through from rail to rail.

In accordance with the present invention, an upper end portion 12A of the guide track 12 has a short horizontal segment formed with indentations 22 therein of spherical shape. These indentations 22 are adapted to provide a detent for retaining a bowling ball 24 of conventional size and weight in a rest or stationary position ready for discharge down the ramp. The indentations 22 are formed on the inside upper edge portions of the horizontal segment 12A of the guide track 12 and prevent the bowling ball 24 from moving down the track forwardly until forward pressure is applied by a bowler 26 (arrow C) either in standing position (FIG. 1) or in seated position (FIG. 5) in a wheelchair 28.

Figure 6:
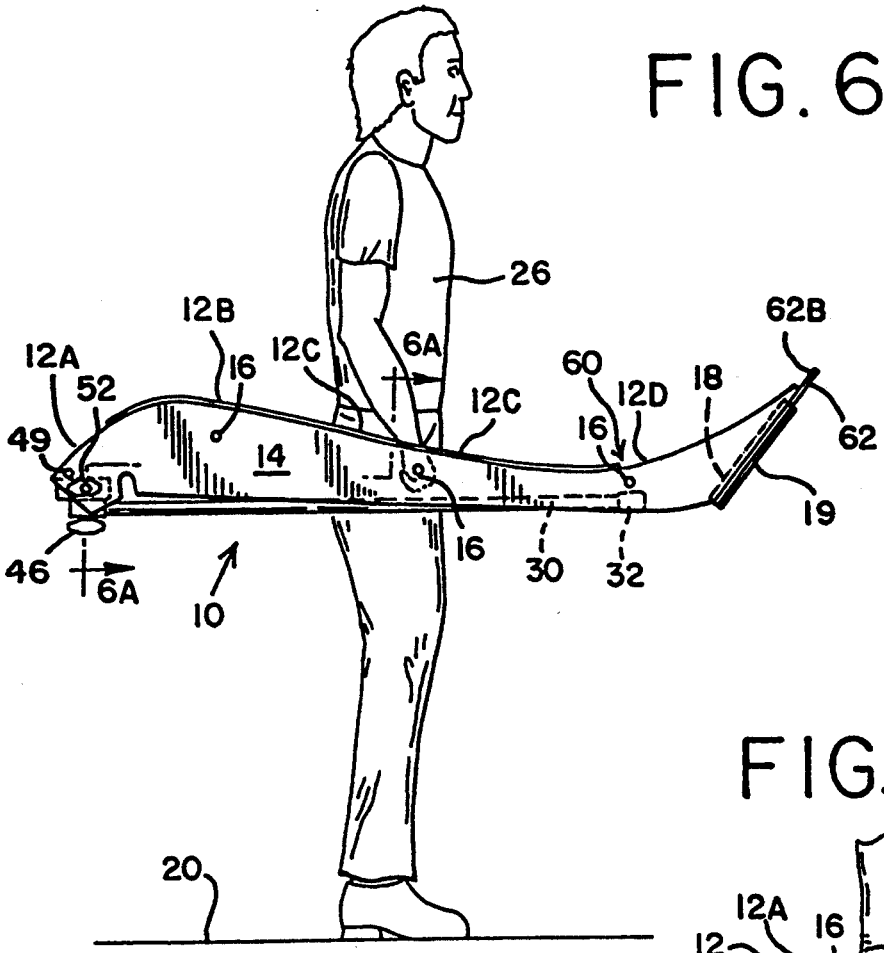
FIG. 6 is a side elevational view of the bowling ramp of the present invention shown in a folded-up compact condition ready for easy carrying from place to place or storage.

Referring to FIGS. 1–4, in accordance with the invention the bowling ramp 10 is provided with a pair of rear legs 30 pivotally interconnected at the upper ends thereof to the horizontal upper end section 12A of the guide track 12. At the lower end, each support leg 30 is provided with a rubber crutch tip 32 or other friction pad adapted to engage the surface 20 and prevent movement relative thereto during bowling operations. The legs 30 are pivotal relative to the guide track 12 about a horizontal transversely extending or lateral axis 34 best shown in FIGS. 2 and 3 for movement between a spread out, rearwardly extending operational position as shown in FIG. 1 or a folded-up, carrying or transport and storage position as shown in FIG. 6 when the bowling ramp is folded-up ready for travel.

In addition, as best shown in FIGS. 2 and 3, each leg 30 is pivotable laterally outwardly relative to the upper end section 12A of the guide track 12 about a longitudinally extending axis 36 so that the legs may be pivoted laterally outwardly from an inward parallel folded-up position (FIG. 6A) parallel to the guide track 12 to a laterally outwardly extended operational position as shown in FIGS. 2 and 3. With the legs in the outward position, excellent lateral or transverse stability is provided for the bowling ramp 10 when used for bowling.

As best shown in FIGS. 2 and 3, upper end portions of the legs 30 are pivotally secured to a channelshaped metal spacer bracket 40 having a pair of parallel spaced-apart, threaded pins 38 secured to a web portion 42 of the bracket. The pins 38 extend outwardly through metal sleeves 44 provided on upper end portions of the legs 30 and each pin 38 is threaded adjacent an outer end for a thumb screw-type knobs or wing nuts 46 which are tightened to lock the legs in a selected position either folded-up (FIG. 6) for carrying or in an extended position ready for operation. The manually operated locking wing nuts 46 are readily tightened or loosened to clamp or unclamp the sleeves 44 and respective legs 30 tightly against the web 42 of the bracket 40 in a selected position, either a folded-up position (FIG. 6A) or laterally outwardly extended position (FIGS. 2 and 3).

The channel bracket 40 also includes a pair of opposite side flanges 48 joining the opposite edges of the central web 42. The side flanges 48 bear outwardly against the inside surfaces of the respective side rails 14 of the guide track 12. A threaded pin 50 extends through each flange 48 to extend outwardly through a hole provided in the adjacent side rail 14 and a lock knob 52 is provided on a threaded outer end portion of the pin to secure the bracket 40 in a selected rotative position for supporting the legs 30 either in a rearwardly extended operative position as shown in FIGS. 1–4 or a retracted, folded-up condition as shown in FIG. 6, wherein the bowling ramp 10 is compact in size and easily carried from place to place or stored in a compact configuration taking up very little space.

Figure 6A:
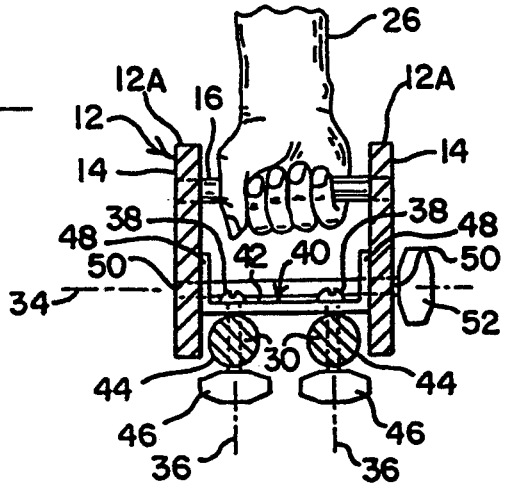
FIG. 6A is a fragmentary cross-sectional view of the bowling ramp taken substantially along lines 6A—6A of FIG. 6.

The threaded pivot pin 50 passes through the flanges 48 and are coaxially aligned along the transverse axis 34 so that the bracket 40 with the legs 30 secured thereto can be pivoted between the folded-up or retracted position of FIG. 6 and the extended position of FIGS. 1–4 ready for use (FIG. 1A) wherein edges of the flanges 48 bear against a stop pin 49 extending between the side rails 14 and in spaced parallel relation with the pin 50. In either position the legs 30 are securely locked in a selected position when the wing nuts 46 and knob 52 are tightened. Referring to FIG. 3, at the upper end, each leg 30 has an angular upper end surface 30A forming a stop against that of an opposite leg to limit the amount of lateral outward extension of the legs in the operating position shown in FIGS. 2 and 3. When the wing nuts 46 are subsequently loosened, the legs 30 may be pivoted inwardly towards one another to the folded-up or retracted parallel position as shown in FIGS. 6 and 6A. It will thus be seen that the legs 30 are movable relative to one another in a lateral direction outwardly of the guide track 12 on opposite sides and also movable in unison about the axis 34 toward and away from the underside of the elongated guide track structure 12 between the rearward extended operating position FIGS. 1–4 and a retracted or parallel carrying position (FIG. 6).

In accordance with an important feature of the present invention, the upper edge of the guide track side rail 14 is provided with a friction creating, elongated tape or web 60 having a rough upper surface adapted to frictionally engage, a bowling ball 24 as the ball moves down the rather steep incline guided by the rails 14 of the guide track 12. As illustrated best in FIG. 1, the frictional engagement between the bowling ball 24 and the tape web 60 on the rails 14 of the guide track 12 causes the ball to spin or rotate as indicated by the arrows A in FIG. 1. This spinning action provides gyroscopic stability for the moving ball 24 and generally results in accurate and precise directional movement of the ball as it rolls down the alley after being discharged from the lower end portion of the bowling ramp 10, as indicated by the arrow B in FIG. 1.

The side rails 14 of the guide track 12 include a curved upper section 12B adjacent to the horizontal upper section 12A and a relative steeply sloped main section 12C transitioning at the lower end of the guide track into a curved lower end section 12D having an arcuate-shaped upper edge substantially tangent to the surface of the bowling alley 20 to impart a fast spinning ball 24 to move rapidly down the alley as indicated by the arrow B. The spacing between the side rails 14 of the guide track 12 is somewhat less than the diameter of the bowling ball 24 and accordingly, the ball is frictionally engaged on opposite sides of center by friction webs 60 on the rails 14 so that excellent spinning action results as the ball moves forwardly out of the detents 22 on the upper section 12A of the guide track 12 as indicated in FIG. 1 the arrow C.

Figure 4A:
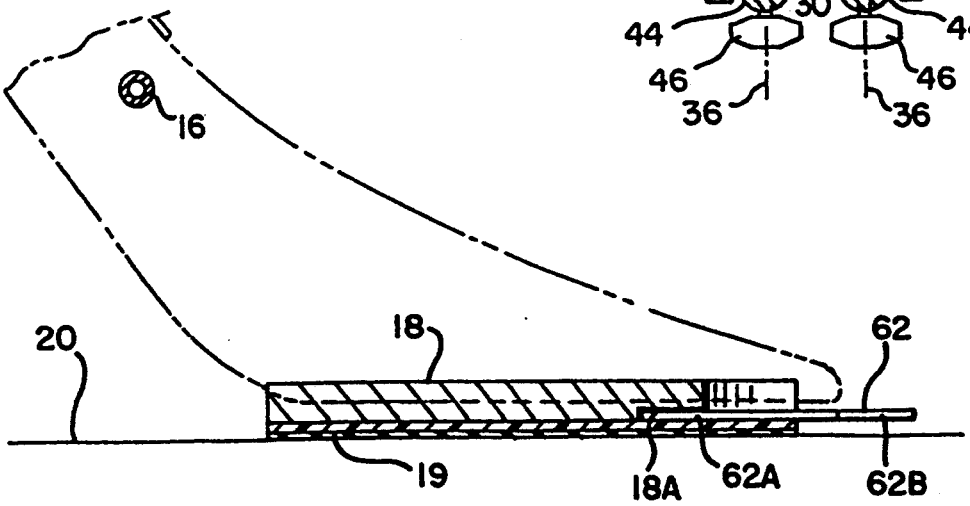
FIG. 4A is an enlarged fragmentary longitudinal cross-sectional view of the bowling ramp looking in the direction of arrows 4A—4A of FIG. 4.

In order to aim the guide track 12 with the bowling alley and in particular, the longitudinal extending wooden boards or alley members 20A as shown in FIG. 4, the bowling ramp 10 is provided with a protractor-like guide or aiming element 62 formed of thin plastic sheet material and adapted to be positioned as shown in FIG. 4 with arms 62B aligned to extend transversely outwardly of the foot board 18 on opposite sides of the guide rails 14. The alignment or aiming guide 62 includes a central base portion 62A which is slidable into a central slot 18A in the foot board 18 as best shown in FIG. 4A. When the bowling ramp 10 is folded-up into the carrying position, the plastic aiming guide 62 may be easily removed from the slot 18A.

Figure 5:
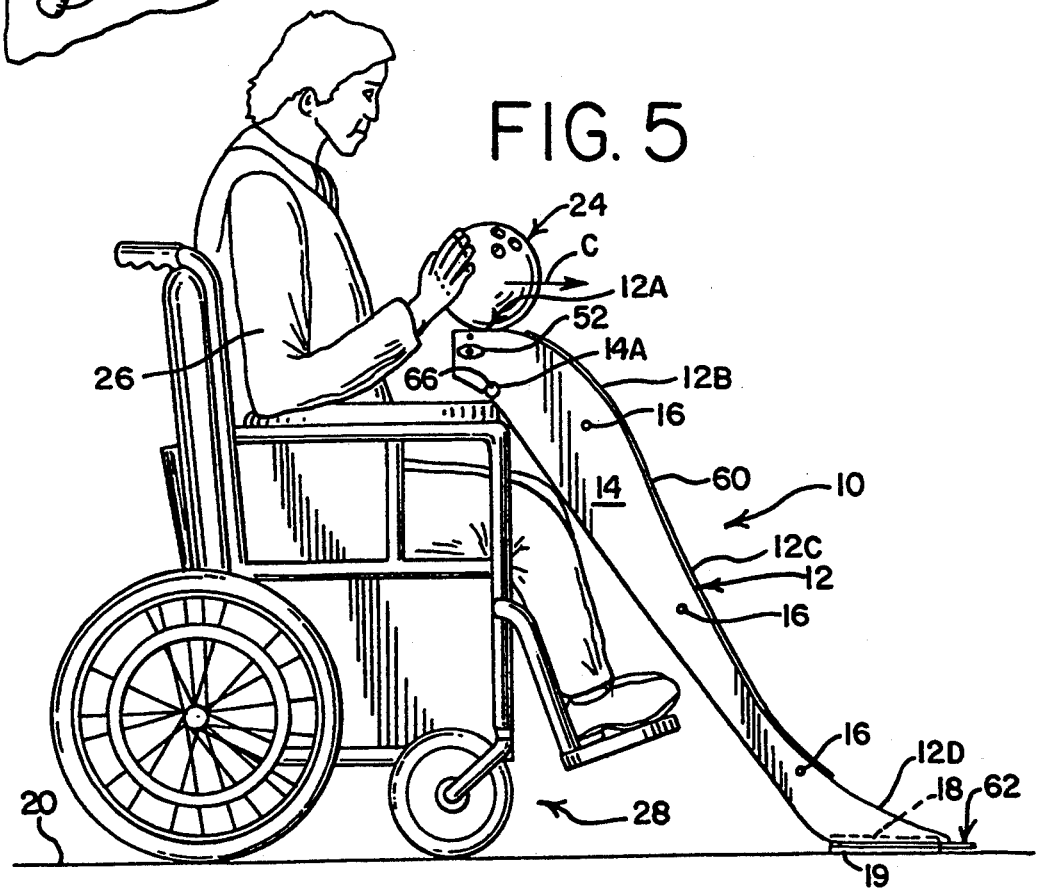
FIG. 5 is a side elevational view of the bowling ramp in accordance with the present invention ready for use by a person sitting in a wheelchair.

Referring briefly to FIG. 5, the bowling ramp 10 can also be utilized in connection with a wheelchair 28 and for this purpose an upper portion on the underside of the side rails 14 is formed with a notch 14A in which is seated a transverse cross-bar 66 adapted to rest on the armrest cushions of the wheelchair 28 or other support for supporting the upper end section 12A of the guide track 12 with the bowling ball 24 resting in place as shown. If the bowling ramp 10 is to be used with a wheelchair 28, the legs 30 are collapsed so as not to interfere with the legs of the wheelchair patient 26.

It will also be seen in FIG. 4 that when the bowling ramp 10 is in an operative position for use by a person 26 in a standing position as shown in FIG. 1, the rearwardly and laterally outwardly extension of the legs 30 provide a convenient open space of triangular shape so that the bowler can stand up close to the rear end of the ramp as indicated by the footprint outlines 26A in FIG. 4.

When the bowling ramp 10 is folded-up (FIG. 6), the wing nuts 46 and the knob 52 are tightened to secure the legs 30 in a parallel and fully retracted position between the opposite side rails 14 of the guide track 12 as shown in FIG. 6A. In this position, the lightweight bowling ramp 10 can easily be carried for transporting the ramp to storage or another place of use.

When it is desired to set up the bowling ramp ready for play, the wing nuts 46 and the knob 52 are loosened and the legs 30 and bracket 40 are pivoted about the transverse axis 34 until the desired rearward position is attained and then the knob 52 is tightened. The wing nuts 46 are likewise loosened and the legs 30 are spread apart laterally at the lower ends 32 until the stop surfaces 30A at the upper end of the legs abut one another to provide a stop and thus limit the outward lateral spread of the legs. The knobs 52 are then tightened to secure the legs in place. Because the bowling ramp is light in weight, it is easily manipulated and may weigh as little as 8 pounds including all of the included paraphernalia as described. Also, before use, the protractor-like plastic aiming guide 62 is positioned with the central portion 62A thereof in the slot 18A of the foot board 18 between the rails 14.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A bowling ramp useful for acceleration and directional control of a bowling ball by handicapped, disabled, weak and infirm persons of all ages, comprising:

sloping guide track means having a lower end adapted to rest on a bowling alley surface and an upper end having a horizontal segment adapted to support a bowling ball at rest;

leg means having an upper end connected to support said upper end of said guide track means and a lower end adapted to be supported from said bowling alley surface;

friction means on said guide track means for engaging a bowling ball moving downwardly on said track means causing said ball to spin about a roll axis extending through said bowling ball; and alignment means adjacent a lower end of said ramp extending laterally outwards of said guide track means over said bowling alley surface for aiding in the directional alignment of said ramp with respect thereto.

2. The bowling ramp of claim 1, wherein:

said friction means is positioned on a downwardly sloping portion of said guide track means.

3. The bowling ramp of claim 2, wherein:

said friction means comprises tape means secured to said guide track means having a relatively rough outer surface for frictional engagement with said bowling ball.

4. The bowling ramp of claim 1, including:

detent means on said horizontal segment of said guide track means for preventing a bowling ball from rolling off an end thereof.

5. The bowling ramp of claim 1, wherein:

said guide track means includes curved segments adjacent said upper and said lower ends.

6. The bowling ramp of claim 5, wherein:

said curved segment at said lower end of said guide track means is provided with a curve substantially tangent to said bowling alley surface.

7. The bowling ramp of claim 5, wherein:

said curved segment at said upper end of said guide track means joins said horizontal segment thereof.

8. The bowling ramp of claim 1, including:

friction pad means adjacent said lower end of said leg means for engagement against said bowling alley surface to prevent movement thereon while a bowling ball is moving down said guide track means.

9. The bowling ramp of claim 8, wherein:

said friction pad means includes a resilient pad for securing a forward end of said ramp against movement relative to said bowling alley surface while a bowling ball travels down said guide track means.

10. A bowling ramp for accelerating and directional control of a bowling ball rolling downwardly thereon for discharge onto a bowling surface, comprising:

said ramp including an upper section adapted to support a bowling ball at rest at an elevation above said bowling surface, and a downwardly and forwardly directed guide track for accelerating and directionally controlling a bowling ball moved off of said upper section on a line toward said bowling surface;

leg means for supporting said upper section of said ramp above said bowling surface including lower portions extending downwardly and laterally transverse relative to said line of guide track for engaging said bowling surface at the lower end to laterally stabilize said ramp;

friction means on said guide track for causing a bowling ball moving down said guide track to spin and roll onto said bowling surface; and alignment means detachably mounted adjacent lower end portions of said rails extending laterally outwardly thereof for aligning the forward end of said guide track on said bowling surface.

11. The bowling ramp of claim 10, wherein:

leg means includes a pair of legs pivotally attached adjacent said upper section and having lower ends movable laterally outwardly to a laterally extended position engaging said bowling surface outwardly on opposite sides of said guide track to provide lateral stability.

12. The bowling ramp of claim 11, including:

means for pivotally interconnecting upper ends of said pair of legs for pivotal movement relative to said guide track between an extended position for bowling and a folded-up position for easy carrying and storage.

13. The bowling ramp of claim 12, including:

lock means for releasably securing said legs in said folded-up position.

14. The bowling ramp of claim 13, wherein:

said lock means includes means operable for sealably securing said legs in said extended position for bowling.

15. The bowling ramp of claim 11, including:

stop means for limiting the amount of pivotal movement between said legs and said guide track for setting up said extended position.

16. The bowling ramp of claim 10, wherein:

said guide track includes a plurality of spaced apart parallel rails having upper edges for engaging said bowling ball on opposite surfaces thereon.

17. The bowling ramp of claim 16, wherein:

said upper section is formed by upper end portions of said parallel rails.

18. The bowling ramp of claim 17, including:

recesses formed on inside facing sides of said upper end portions of said rails for retaining a bowling ball in place on said upper section until the ball is forcibly moved down said guide track.

* * * * *